US009770878B2

(12) United States Patent
Correale, Jr.

(10) Patent No.: US 9,770,878 B2
(45) Date of Patent: Sep. 26, 2017

(54) LIQUID STORAGE SYSTEM FOR COMPACTOR

(71) Applicant: PTR Baler and Compactor Company, Philadelphia, PA (US)

(72) Inventor: Edward Howard Correale, Jr., Levittown, PA (US)

(73) Assignee: PTR Baler and Compactor Company, Philadelpiha, PA (US)

( * ) Notice: Subject to any disclaimer, the term of this patent is extended or adjusted under 35 U.S.C. 154(b) by 745 days.

(21) Appl. No.: 13/723,918

(22) Filed: Dec. 21, 2012

(65) Prior Publication Data

US 2013/0160662 A1 Jun. 27, 2013

Related U.S. Application Data

(60) Provisional application No. 61/578,598, filed on Dec. 21, 2011.

(51) Int. Cl.

| | |
|---|---|
| ***B30B 13/00*** | (2006.01) |
| ***B30B 9/02*** | (2006.01) |
| ***B30B 15/00*** | (2006.01) |
| ***B30B 9/30*** | (2006.01) |

(52) U.S. Cl.

CPC ..... *B30B 9/02* (2013.01); *B30B 9/3039* (2013.01); *B30B 9/3046* (2013.01); *B30B 13/00* (2013.01); *B30B 15/00* (2013.01)

(58) Field of Classification Search

CPC .... B30B 9/02; B30B 9/04; B30B 9/06; B30B 9/067; B30B 9/3046; B30B 9/3039; B30B 9/3042; B30B 15/00

USPC .... 100/104, 110, 111, 126, 127, 226, 229 A, 100/240, 245, 246; 414/512, 517

See application file for complete search history.

(56) References Cited

U.S. PATENT DOCUMENTS

| | | | | |
|---|---|---|---|---|
| 3,807,294 | A * | 4/1974 | Ligh | 100/50 |
| 3,880,072 | A * | 4/1975 | Ord | B30B 9/3042 100/100 |
| 4,359,789 | A * | 11/1982 | Roberts | E03B 1/041 210/167.32 |
| 4,557,658 | A * | 12/1985 | Lutz | 414/517 |
| 4,805,660 | A * | 2/1989 | Antos et al. | 137/202 |
| 5,389,346 | A * | 2/1995 | Copeland, Jr. | 422/292 |
| 5,575,201 | A * | 11/1996 | Fenner et al. | 100/39 |
| 5,622,103 | A * | 4/1997 | Acosta | B30B 9/3021 100/100 |
| 6,067,900 | A * | 5/2000 | Lackner et al. | 100/111 |
| 6,148,846 | A * | 11/2000 | Schell | 137/208 |
| 6,247,397 | B1 * | 6/2001 | Diotalevi | 100/71 |
| 2003/0024568 | A1 * | 2/2003 | Bowman | 137/217 |

* cited by examiner

*Primary Examiner* — Jimmy T Nguyen

(74) *Attorney, Agent, or Firm* — Panitch Schwarze Belisario & Nadel LLP

(57) ABSTRACT

A compactor system for compacting waste having liquid components. The compactor system includes a storage container having a storage chamber and a dump door. A charge container includes a compacting chamber and a loading opening. An outlet fitting is mounted to the charge container. The outlet fitting is in fluid communication with the compacting chamber. A pump is in fluid communication with the outlet fitting. A storage tank is in fluid communication with the pump. The storage tank, storage container and charge container are positioned on a support surface. The pump pumps fluid from the compacting chamber into the storage tank.

15 Claims, 2 Drawing Sheets

LIQUID STORAGE SYSTEM FOR COMPACTOR

CROSS-REFERENCE TO RELATED APPLICATIONS

The present application claims the benefit of U.S. Provisional Patent Application No. 61/578,598, filed on Dec. 21, 2011, entitled "Liquid Storage System for Compactor," the entire contents of which is incorporated herein by reference in its entirety

BACKGROUND OF THE INVENTION

Compactors for compacting trash, such as time expired foodstuffs, drink containers or other waste that may include liquids therein, are generally known. These compactors generally include a container or housing with a closable opening or door for inserting the trash therein. The compactor generally includes a hydraulically powered ram for compressing or compacting the trash within the housing. The compactors also include an opening for dumping the compacted trash. The container may be transportable from its store location to a waste disposal facility to dump the compacted waste. Liquids that are squeezed out of our otherwise spill from the waste often pool in the bottom of the container, thereby creating a mess if they leak from the container. The pooled liquid also adds significant weight to the container, creates foul odors and potential corrosion to the container. The pooled liquids may be drained from the compactor for disposal into a conventional drainage system, but certain regulations prevent drainage and conventional disposal of such liquids, often requiring specialized disposal. The liquids may be drained into underground storage tanks, but the underground tanks are expensive to install and maintain.

While existing compactors are effective in compacting trash, compactors that are used in certain environments, such as movie theatres and grocery stores, are vulnerable to material failure and degradation over time. For example, compactors that are subjected to the pooled liquids often need repair and/or replacement. Specifically, movie theatre and grocery store waste typically contains remnants of the food and/or drinks, such as soft drinks, pop corn oils, spoiled fruits, expired milk and other residual liquids from a variety of other foods. These types of waste generally comprise highly acidic, abrasive and caustic materials. When the compactor is repeatedly used for compacting these materials and the pooled liquids remain in the compactor for extended periods of time, often in high temperature environments, the metals that form the frame and join components of the compactor begin to corrode, break down, and require repair and/or replacement. Further, the cost to repair or replacement of the compactor can be cost prohibitive.

In addition, the liquid waste that is contained in the compactor is relatively heavy, particularly in comparison to the solid waste, such as paper and packaging materials. When the compactor is filled with waste, the compactor container is hauled to a waste facility and dumped. Payment for dumping the waste is calculated based on the weight of waste dumped at the facility. Accordingly, the relatively heavy liquid waste can add significant cost to the hauler. Certain compactors permit draining of the liquid waste from the compactor container prior to hauling the container to the waste facility to reduce hauler costs. Such container drainage systems typically drain by gravity into an underground tank. Installation and maintenance of the underground tank is relatively expensive and may not be appropriate for all locations where compactors are deployed. In addition, the waste liquids can cause corrosion of the storage tanks when stored for extended periods of time and foul odors in the area of the underground storage tanks.

It is desirable to design and install a compactor that has a relatively simple and efficient system to protect the compactor against corrosive and acidic liquid waste. It is also desirable to design and install a system for draining liquid waste from a compactor that is relatively easy to install, maintain and operate to protect the compactor against corrosive and acidic waste, avoid or at least diminish degradation and failure of the compactor and reduce costs incurred by a hauler when dumping the compacted waste at a waste facility.

BRIEF SUMMARY OF THE INVENTION

Briefly stated, a preferred embodiment of the present application is directed to a compactor for compacting waste having liquid components. The compactor includes a storage container having a storage chamber and a dump door. A charge container includes a compacting chamber and a loading opening. An outlet fitting is mounted to the charge container and is in fluid communication with the compacting chamber. A pump is in fluid communication with the outlet fitting. A storage tank is in fluid communication with the pump. The storage tank, storage container and charge container are positioned on a support surface. The pump pumps fluid from the compacting chamber into the storage tank.

BRIEF DESCRIPTION OF THE DRAWINGS

The foregoing summary, as well as the following detailed description of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
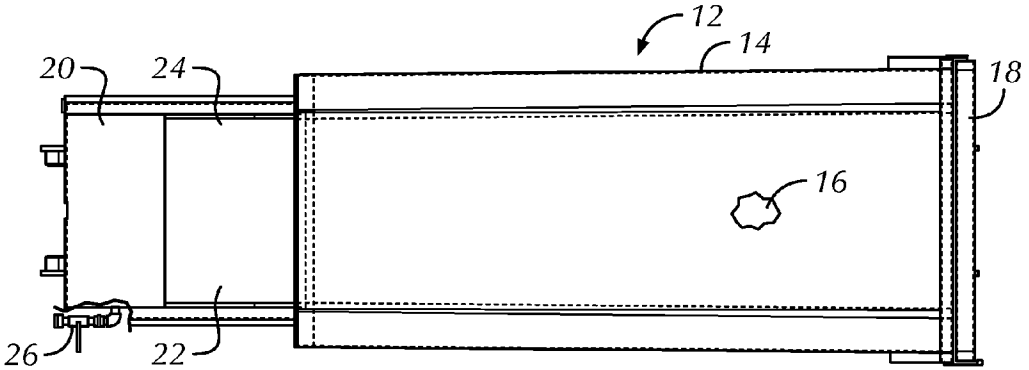
FIG. 1 is a top plan view of a self-contained compactor in accordance with a preferred embodiment of the present application.

Certain terminology is used in the following description for convenience only and is not limiting. The words "right," "left," "lower," and "upper" designate directions in the drawings to which reference is made. The words "inwardly" or "distally" and "outwardly" or "proximally" refer to directions toward and away from, respectively, the geometric center or orientation of the liquid storage system, the compactor and related parts thereof. Unless specifically set forth herein, the terms "a", "an" and "the" are not limited to one element but instead should be read as meaning "at least one". The terminology includes the above-listed words, derivatives thereof and words of similar import.

Figure 2:
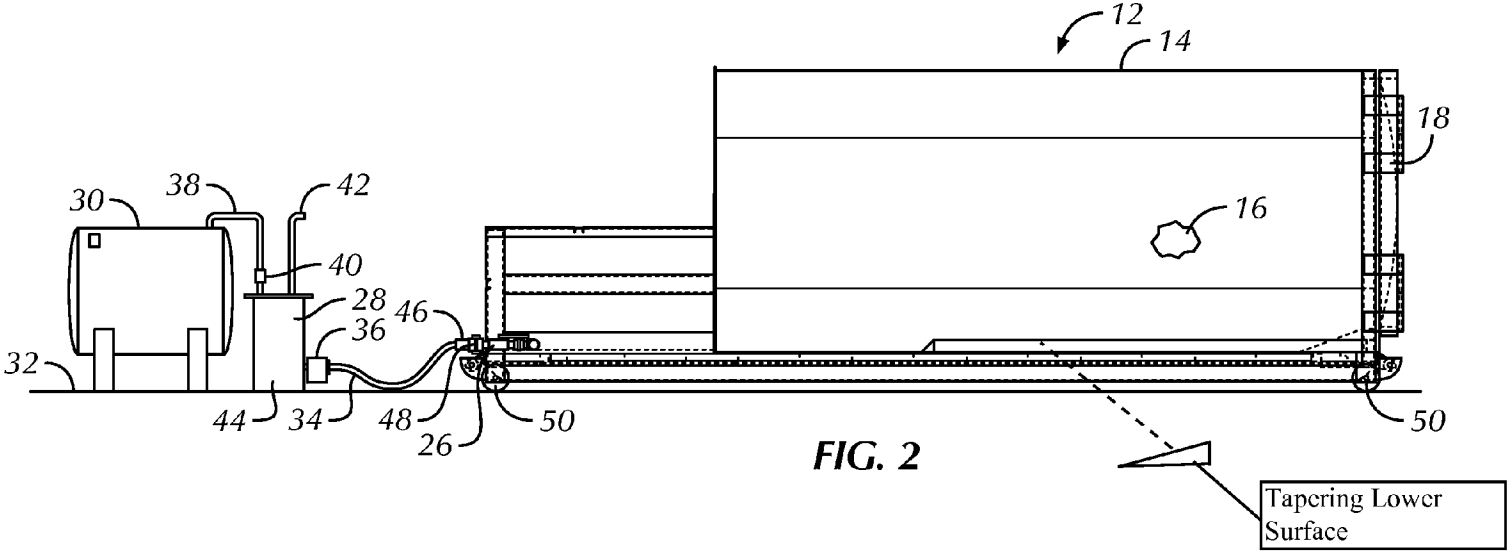
FIG. 2 is a side elevational view of a compactor system of the preferred embodiment including the self-contained compactor of FIG. 1.
Figure 3:
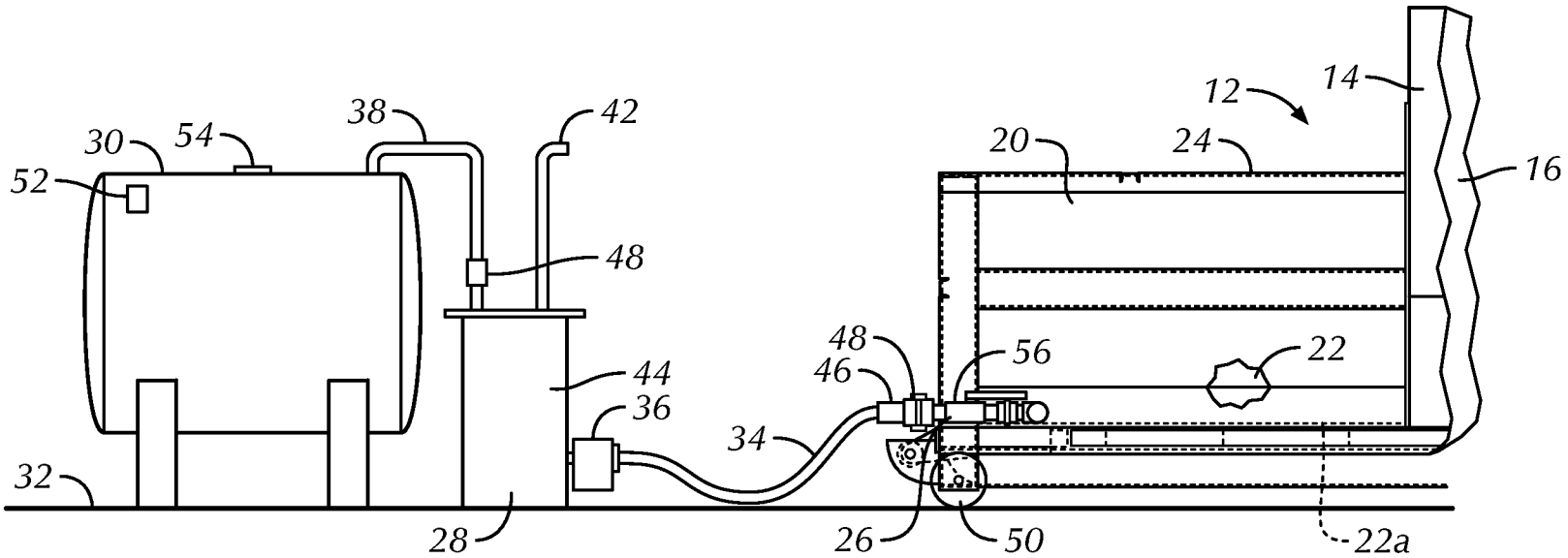
FIG. 3 is a magnified side elevational view of components of the compactor system of FIG. 2.

Referring to FIGS. 1-3, the present application is directed to a compactor system 10 for compacting waste having liquid components. The compactor system 10 preferably includes a self-contained compactor 12 including a storage container 14 having a storage chamber 16 therein and a dump door 18. The compactor system 10 also includes a charge container 20 including a compacting chamber 22 and a loading opening 24. The compactor system 10 further includes an outlet fitting 26 mounted to the charge container 20. The outlet fitting 26 is in fluid communication with the compacting chamber 22 and the storage chamber 16. A pump 28 is in fluid communication with the outlet fitting 26. A storage tank 30 is in fluid communication with the pump 28. The storage tank 30, storage container 14, and charge container 20 are positioned on a support surface 32. The pump 28 is utilized to pump fluid from the compacting chamber 22 and/or storage chamber 16 into the storage tank 30.

The self-contained compactor 12 and its related components are preferably constructed of corrosion resistant metallic materials or coated metallic materials. In the preferred embodiment, the self-contained compactor 10 is constructed generally of corrosion resistant steel or coated steel components that are welded or otherwise fastened together to define the self-contained compactor 12. The self-contained compactor 12 is not limited to constructions using steel, metallic or coated materials and may be constructed of nearly any material that is relatively strong and stiff, is able to take on the general size and shape of the self-contained compactor 12 and withstand the normal operating conditions of the self-contained compactor 12. For example, the self-contained compactor 12 may be constructed of a generally corrosion resistant composite material or a variety of composite materials.

The charge container 20 preferably receives waste through its loading opening 24 for compacting the waste in the compacting chamber 22. The waste compacted in the compacting chamber 22 may include liquid waste or liquids may be expelled from the discarded containers or other waste during the compacting process in the compacting chamber 22. The liquids typically drain from the waste toward a bottom surface 22*a* of the compacting chamber 22 and/or toward a bottom surface of the storage container 14. This liquid waste can include toxic, acidic and/or other corrosive materials that have a tendency to corrode the components of the self-contained compactor 20. In addition, the liquid waste adds significant weight to the self contained compactor 12, is relatively messy, may create a foul smell and/or unsightly spills if and when the dump door 18 is opened or the liquid otherwise escapes from the self-contained compactor 12.

To facilitate disposal of the liquid waste that may pool in the compacting chamber 22 and/or the storage chamber 16, the waste fluid may be pumped out of the self-contained compactor 12 with the pump 28. When fluid is present, the fluid or liquid flows through the outlet fitting 26, through an outlet hose 34, through a strainer 36 to remove solids too large to pass through the pump 28, through the pump 28, through a pump hose 38 and into the storage tank 30. The solids that are collected in the strainer 36 may be removed and placed into the storage chamber 16 or may be otherwise disposed. The pump 28, storage tank 30 and self-contained compactor 12 are preferably supported by the support surface 32, such that they are all generally positioned at the same elevation. In this arrangement, the pump 28 is utilized to pump the liquid, against the force of gravity, from the bottom of the compacting chamber 22 and storage chamber 14 into the storage tank 30. Positioning the storage tank 30 above ground or above the support surface 32 provides a relatively simple and inexpensive installation for the storage tank 30 and makes emptying of the storage tank 30 relatively simple and easy for a technician.

A check valve 40 is preferably secured to the pump hose 38 to prevent the waste from flowing back into the pump 28 from the storage tank 30. In addition, a vent 42 is preferably provided for the pump 28 to vent odors and gases from the pump 28 in the preferred embodiment. The pump 28 is preferably located in a pump tank 44 that receives the waste liquid from the compacting chamber 22 and storage chamber 16 through the outlet fitting 26 and the outlet hose 34. The pump 28 is preferably comprised of a float controlled waste water pump capable of pumping water with solid contaminants under a predetermined size. Accordingly, the strainer 36 is preferably selected such that it strains or removes solids from the waste liquids that are larger than the size which may be handled by the pump 28.

A check valve 46 is also preferably associated with the outlet hose 34 and is mounted proximate a quick connect 48 at the end of the outlet hose 34 that connects to the outlet fitting 26. The check valve 46 is included to generally prevent liquid from flowing from the outlet hose 34 back through the outlet fitting 26 and into the compacting chamber 22 or storage chamber 16. The quick connect 48 permits relatively simple and quick connection and removal of the outlet hose 34 from the outlet fitting 26. Disconnection of the outlet hose 34 from the outlet fitting 26 permits transport of the self-contained compactor 12 to a disposal facility to dump the compacted waste. The self-contained compactor 12 also includes wheels 50 that permit transport or movement of the self-contained compactor 12.

The storage tank 30 preferably includes a float valve 52 to stop the pump 28 from urging additional fluid into the storage tank 30 when the storage tank 30 is full or at least near capacity. The float valve 52 may be in communication with a compactor control panel (not shown) to trigger a warning light to a user to indicate that the storage tank 30 is full or nearly full of fluid. Such warning light may indicate to the user that the storage tank 30 needs to be emptied or that a service provider needs to be called to empty the storage tank 30. The float valve 52 may alternatively be directly in communication with maintenance personnel or a third party service provider to provide an indication that the storage tank 30 is full or nearly full and the liquid needs to be emptied. The maintenance personnel or third party service provider may be specially trained at disposing the liquid waste and may be able to more economically and properly dispose of the liquid in the storage tank 30 than a hauler who disposes of the solid compacted waste in the storage chamber 16.

The storage tank 30 is preferably mounted above ground or above the support surface 32 as such an installation is generally more cost effective and simpler than a below ground installation. In addition, the above-ground storage tank 30 is easier to visibly inspect for potential damage and may be easier for maintenance personnel or a third party to drain by using gravity to drain the fluid therein. The storage tank 30 also preferably includes a vent cap 54 mounted thereto that permits venting of gases from the storage tank 30. The vent cap 54 may also be utilized to uncover an outlet opening to facilitate emptying of the fluids from the storage tank 30 by maintenance personnel or a third party disposal group.

In operation, waste, including waste that has liquids therein, such as fruits, vegetables, drink containers, expired perishable foods or other potentially wet waste, is loaded into the charge container 20 through the loading opening 24.

The loading opening 24 is typically protected by an inlet chute (not shown) and a locked door (not shown) that limits access to the loading opening 24. The loading door and chute also provide safety to prevent a user from inadvertently falling into the compacting chamber 20 during compacting of the waste. The loading door may be located inside of a building, typically in a storage warehouse wherein product packaging is removed from products, and the loading chute may direct the waste from inside the building into the compacting chamber 22. Alternatively, the loading opening 24 may be covered by a movable loading door (not shown) on the charge container 20, which is lockable during compacting and may be opened for leading of the compacting chamber.

During use, the user actuates the compactor 12 to compact the waste in the compacting chamber 22, thereby squeezing some of the liquid waste out of the solid waste. The loading door is locked and closed during the compacting process and compacting is preferably locked out when the loading door is open. The liquid waste typically flows via gravity to the bottom surface 22*a* of the compacting chamber 22 or the bottom of the storage chamber 16 and may be urged toward the outlet fitting 26 by the shape, configuration and/or size of the inner surfaces, such as by sloping or tapering the lower surfaces of the charge container 20 and storage container 14 toward the outlet fitting 26. In addition, a trough or channel (not shown) may be included in the bottom of the charge container 20 and the storage container 14 that is sloped toward the outlet fitting 26 to urge the fluid waste toward the outlet fitting 26 via gravity. The trough or channel may be covered by a screen or filter that generally prevents the compacted waste from entering the trough or channel and blocking the trough or channel.

A manual shutoff valve 56 may be mounted between the outlet fitting 26 and the charge container 20. The manual shutoff valve 56 may be opened to cause the fluid waste to flow through the outlet fitting 26, may be constantly open when the quick connect 48 is secured to the outlet fitting 26 or may be closed to prevent the waste fluid to flow through the outlet fitting 26. Preferably, the manual shutoff valve 56 is left in an open position as much as possible to permit liquid waste to flow out of the self-contained compactor 12 as quickly and consistently as possible. The waste fluid flows through the outlet fitting 26, through the quick connect 48, through the check valve 46, through the outlet hose 34 and into the strainer 36. Solids that are too large to pass through the strainer 36 are captured by the strainer 36 and the remaining smaller solids and waste liquid flow into the pump tank 44. When the fluid reaches a predetermined height in the pump tank 44, the pump 28 is actuated to pump the waste fluid through the pump hose 38 and into the storage tank 30. The liquid waste is subsequently drained from the storage tank 30 for disposal by maintenance personnel or a third party disposal group. The liquid waste may be drained from the storage tank 30 at nearly any time, but is preferably drained when or before the float valve 52 provides an indication to the user, maintenance personnel or a third party group that the storage tank 30 is full or nearly full.

The maintenance personnel or a third party group may be able to dispose of the liquid waste more economically than a hauler who takes the self-contained compactor 12 to a disposal facility. For example, in certain jurisdictions, the liquid waste in the storage tank 30 may be directly disposed into a municipal liquid waste facility or alternatively disposed.

Draining of the liquid waste from the compacting chamber 22 and storage chamber 16 removes the liquid waste from these chambers 22, 16, thereby reducing or eliminating the corrosive impact of these materials on the self-contained compactor 12. In addition, removal of the liquid waste from the self-contained compactor 12 limits the foul odors and potential mess that may be created by the liquid waste. Further, removal of the liquid waste from the self-contained compactor 12 reduces the weight of the self-contained compactor 12 when transported to the waste facility and, therefore, costs associated with disposing the waste. The preferred system 10 also permits separate disposal of the liquid waste, which provides the user with additional, preferably favorable options for disposing of the liquid waste. Such options may be safer and/or more cost effective than alternative disposal techniques and methods for liquid waste disposal.

It will be appreciated by those skilled in the art that changes could be made to the embodiments described above without departing from the broad inventive concept thereof. It is understood, therefore, that this invention is not limited to the particular embodiment disclosed, but it is intended to cover modifications within the spirit and scope of the present invention as defined by the appended claims.

I claim:

1. A method for handling waste having solid and liquid components, the method comprising the steps of:

providing a compactor system comprising:

a transportable storage container having a storage chamber and a dump door;

a charge container including a compacting chamber and a loading opening;

an outlet fitting mounted to the charge container, the outlet fitting being in fluid communication with the compacting chamber;

a pump being in fluid communication with the outlet fitting; and a storage tank being in fluid communication with the pump, positioning the storage tank, storage container and charge container on a first support surface, with the storage tank spaced and separate from the storage container and the charge container;

introducing the waste having solid and liquid components into the compacting chamber via the loading opening while the charge container is on the first support surface;

compacting the waste in the compacting chamber while the charge container is on the first support surface to squeeze a portion of the liquid component out of the waste;

placing the solid component of the waste from the compacting chamber into the storage chamber;

activating the pump to pump a portion of the portion of the liquid component of the waste through the outlet fitting and into the storage tank while the charge container is on the first support surface; and after completing the activating the pump step, transporting the storage container containing the solid component of the waste separately from the portion of the liquid component of the waste to a remote second support surface different from the first support surface, the portion of the liquid component remaining in the storage tank positioned on the first support surface.

2. The method of claim 1, wherein the compactor system further comprises:

a check valve positioned between the pump and storage tank; and a strainer positioned between the outlet fitting and the pump, the strainer preventing solids having a predetermined size from flowing into the pump.

3. The method of claim 1, wherein the compactor system further comprises:

an outlet hose secured to the outlet fitting;

a quick connect securing the outlet hose to the outlet fitting, the quick connect permitting disengagement of the outlet hose from the outlet fitting.

4. The method of claim 1, wherein the compactor system further comprises:

a vent cap mounted to the storage tank.

5. The method of claim 1, wherein the compactor system further comprises:

a float valve mounted in the storage tank configured to provide a signal when the storage tank is nearly full of fluid.

6. The method of claim 5, wherein the float valve is in communication with a warning light configured to indicate that the storage tank is full of fluid.

7. The method of claim 1, wherein the compacting chamber and the storage chamber are tapered toward the outlet fitting such that the liquid components in the waste are urged by the force of gravity toward the outlet fitting.

8. The method of claim 1, wherein the pump is positioned in a pump tank and a vent is secured to the pump tank.

9. The method of claim 1, wherein the pump is comprised of a float controlled waste water pump.

10. A method for handling waste having solid and liquid components, the method comprising the steps of:

providing a compactor system comprising:

a transportable storage container having a storage chamber and a dump door;

a charge container including a compacting chamber and a loading opening, the compacting chamber being in fluid communication with the storage chamber, the storage container and the charge container comprising a self-contained compactor;

an outlet fitting mounted to the charge container, the outlet fitting being in fluid communication with the compacting chamber;

a pump being in fluid communication with the outlet fitting via a flexible outlet hose, the flexible outlet hose connected to the outlet fitting by a quick connect; and a storage tank being in fluid communication with the pump, positioning the storage tank, storage container and charge container on a first support surface, with the self-contained compactor spaced and separate from the storage tank;

introducing the waste having solid and liquid components into the compacting chamber via the loading opening while the charge container is on the first support surface;

compacting the waste in the compacting chamber while the charge container is on the first support surface to squeeze a portion of the liquid component out of the waste;

placing the solid component of the waste from the compacting chamber into the storage chamber;

activating the pump to pump a portion of the portion of the liquid component of the waste through the outlet fitting and into the storage tank while the charge container is on the first support surface; and after completing the activating the pump step, transporting the storage container containing the solid component of the waste separately from the portion of the liquid component of the waste to a remote second support surface different from the first support surface, the portion of the liquid component remaining in the storage tank positioned on the first support surface.

11. The method of claim 10, wherein the compactor system further comprises:

a manual shutoff valve mounted between the outlet fitting and the charge container, the manual shutoff valve being movable between an open position to allow fluid to flow from the compacting chamber into the outlet fitting and a closed position blocking flow of fluid from the compacting chamber into the outlet fitting.

12. The method of claim 10, wherein the compactor system further comprises:

an outlet hose secured to the outlet fitting and the pump, the outlet hose being flexible.

13. The method of claim 12, wherein the compactor system further comprises:

a quick connect securing the outlet hose to the outlet fitting.

14. The method of claim 10, wherein the compactor system further comprises:

a pump hose positioned between the pump and the storage tank.

15. The method of claim 10, wherein the compactor system further comprises:

a float valve mounted in the storage tank and configured to alert a user when the storage tank is nearly full of liquid.

* * * * *